US009145650B2

(12) United States Patent
LeBlanc

(10) Patent No.: US 9,145,650 B2
(45) Date of Patent: Sep. 29, 2015

(54) SCARIFIER

(71) Applicant: Alan Edward LeBlanc, Orange, MA (US)

(72) Inventor: Alan Edward LeBlanc, Orange, MA (US)

( * ) Notice: Subject to any disclaimer, the term of this patent is extended or adjusted under 35 U.S.C. 154(b) by 1 day.

(21) Appl. No.: 14/256,131

(22) Filed: Apr. 18, 2014

(65) Prior Publication Data

US 2015/0102653 A1 Apr. 16, 2015

Related U.S. Application Data

(60) Provisional application No. 61/889,214, filed on Oct. 10, 2013.

(51) Int. Cl.

| | |
|---|---|
| ***B28D 1/20*** | (2006.01) |
| ***E01C 23/088*** | (2006.01) |
| ***E01C 19/43*** | (2006.01) |
| *B24B 7/18* | (2006.01) |

(52) U.S. Cl.

CPC ..... *E01C 23/088* (2013.01); *E01C 19/43* (2013.01); *B24B 7/186* (2013.01); *B28D 1/20* (2013.01)

(58) Field of Classification Search

CPC ..... B28D 1/20; B23Q 9/005; B24B 7/186; B24B 7/188; E01C 19/43

USPC ..... 125/38, 13.01, 3; 404/94, 90, 93, 89, 404/103, 106, 132; 299/39.4, 39.6

See application file for complete search history.

(56) References Cited

U.S. PATENT DOCUMENTS

| | | | | | |
|---|---|---|---|---|---|
| 1,630,422 | A * | 5/1927 | Gillespie | 299/39.4 |
| 1,733,198 | A * | 10/1929 | Mullen | 404/117 |
| 1,749,647 | A * | 3/1930 | Poujaud | 404/132 |
| 1,750,896 | A * | 3/1930 | Lichtenberg | 404/106 |
| 2,266,924 | A * | 12/1941 | Tway | 404/132 |
| 2,488,834 | A * | 11/1949 | Simpson | 451/67 |
| 2,584,738 | A * | 2/1952 | Reitz | 144/115 |
| 2,904,320 | A * | 9/1959 | Salisbury et al. | 173/24 |
| 3,063,690 | A * | 11/1962 | Cornell | 299/39.9 |
| 3,398,970 | A * | 8/1968 | Horiuchi | 280/16 |
| 3,603,226 | A * | 9/1971 | Marcovitch | 404/132 |
| 3,608,969 | A * | 9/1971 | Fowkes | 299/1.5 |
| 3,664,393 | A * | 5/1972 | McLeod et al. | 144/117.4 |
| 3,801,211 | A * | 4/1974 | Perkins | 404/75 |
| 3,867,796 | A * | 2/1975 | Sonnenberg | 451/352 |
| 3,907,450 | A * | 9/1975 | Cutler | 299/36.1 |
| 3,975,055 | A * | 8/1976 | Wirtgen | 299/39.6 |
| 4,640,553 | A * | 2/1987 | Zelenka | 299/40.1 |
| 4,754,832 | A * | 7/1988 | Allen et al. | 180/196 |
| 4,762,371 | A * | 8/1988 | Lupton | 299/39.8 |
| 5,203,046 | A * | 4/1993 | Shaw | 15/98 |
| 5,224,301 | A * | 7/1993 | Tasikas | 451/350 |
| 5,908,224 | A * | 6/1999 | Santos | 299/39.2 |
| 6,585,451 | B2 * | 7/2003 | Wynings | 404/131 |
| 6,941,939 | B2 * | 9/2005 | Pedrini | 125/3 |
| 7,000,605 | B2 * | 2/2006 | Due | 125/13.01 |
| 7,497,642 | B2 * | 3/2009 | Raymond et al. | 404/132 |
| 2002/0009961 | A1 * | 1/2002 | Beyersdorff | 451/352 |
| 2003/0016998 | A1 * | 1/2003 | Dubay et al. | 404/83 |
| 2004/0132391 | A1 * | 7/2004 | Kodaverdian et al. | 451/350 |
| 2008/0153402 | A1 * | 6/2008 | Arcona et al. | 451/352 |
| 2014/0227949 | A1 * | 8/2014 | Popov et al. | 451/353 |

* cited by examiner

*Primary Examiner* — George Nguyen

(74) *Attorney, Agent, or Firm* — McClure, Qualey & Rodack, LLP

(57) ABSTRACT

A scarifier comprises skis that allow a drum assembly to contour with the concrete. Alternatively, the scarifier comprises at least two segments that are torsionally coupled to each other. Alternatively, the scarifier comprises the torsionally-coupled segments and the skis.

18 Claims, 8 Drawing Sheets

SCARIFIER

CROSS-REFERENCE TO RELATED APPLICATIONS

This application claims the benefit of U.S. provisional patent application Ser. No. 61/889,214, filed 2013 Oct. 10, by LeBlanc, having the title "Scarifier," which is incorporated herein by reference in its entirety.

BACKGROUND

1. Field of the Disclosure

The present disclosure relates generally to surfacing equipment and, more particularly, scarifiers.

2. Description of Related Art

Surfacing equipment is often used in various environments to modify textures of surfaces. For example, surfacing equipment is used in road construction, paving, and other known applications. Insofar as different environments have different characteristics, surfacing equipment continues to evolve to accommodate those different characteristics.

SUMMARY

The present disclosure provides systems and methods for modifying a surface texture, such as the texture of a concrete floor. Briefly described, in architecture, one embodiment of a scarifier comprises skis that allow a drum assembly to contour with the concrete. Another embodiment of a scarifier comprises at least two segments that are torsionally coupled to each other.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
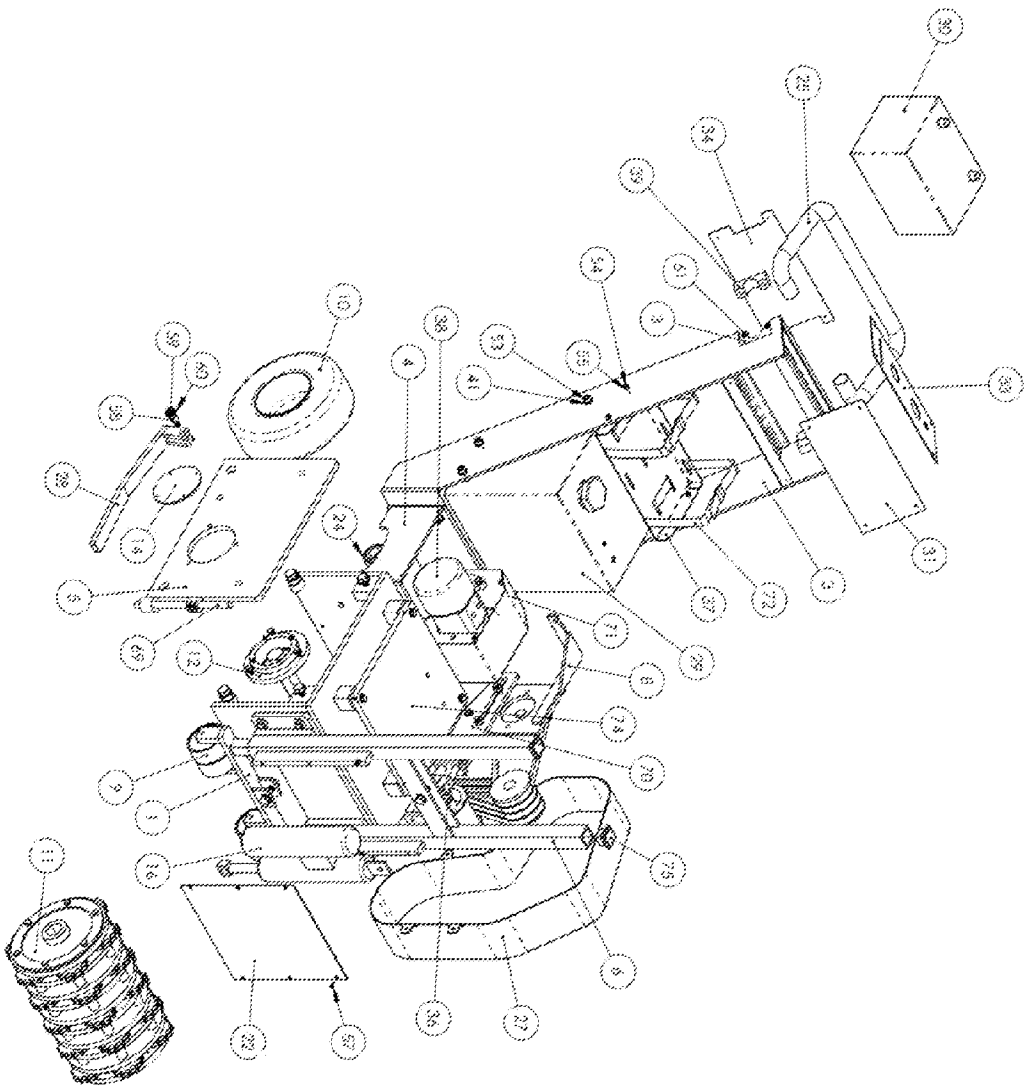
FIG. 1 is a diagram showing an exploded view of one embodiment of a scarifier.

Surfacing equipment is often used in various environments to modify textures of surfaces. For example, scarifiers are used in road construction, paving, and other known applications. Insofar as different environments have different characteristics, surfacing equipment continues to evolve to accommodate those different characteristics. There are various manufacturers of scarifiers, such as, for example, Edco, Smith Manufacturing, Kut-Rite Manufacturing, and Airtec AG. Although these companies manufacture scarifiers, those conventional scarifiers do not permit a drum assembly (with a grinding surface) on the scarifier to contour with the concrete. As such, if one of the wheels of those conventional scarifiers falls into a rut or encounters a bump, then the grinding surface falls or rises as a result of the rut or bump. This results in uneven or inconsistent surfacing.

In order to remedy this shortcoming in conventional scarifiers, several embodiments of a scarifier are shown, which allow the drum assembly (also known as a drum box) of the scarifier to contour with the concrete.

For one embodiment, the scarifier rides on two skis, which allow the drum assembly to contour with the concrete. These skis have an angle that is located at approximately the location where the drum assembly contacts the ground. Consequently, this co-location of the contact point of the drum assembly and the angles on the skis permits the drum assembly to maintain better contact with the concrete. Thus, unlike machinery from other companies, when one of the drive wheels of the inventive scarifier encounters a bump, rut, or other uneven surface, the skis on the scarifier maintains the elevation of the drum assembly with reference to the surface.

In another embodiment, the scarifier has at least two distinct segments that are torsionally coupled to each other. Specifically, a proximal segment is operatively coupled to a middle segment to allow torsional movement of the proximal segment with reference to the middle segment. In terms of roll, pitch, and yaw, the middle segment is coupled with the proximal segment in such a way to allow the middle segment to roll independently of the proximal segment. Stated differently, the flexible coupling between the proximal segment and the middle segment provides an effect that is similar to a twist-beam suspension or a torsion-beam axle. This further allows the drum assembly to contour with the concrete, somewhat independently of the vertical movement of the drive wheels. Thus, even if one of the drive wheels encounters a rut, bump, or other surface defect that causes the wheel to move up or down, the drum assembly (which is in the middle segment) remains relatively even with the ground.

Consequently, the various embodiments of the disclosed walk-behind scarifier is able to achieve results that were previously un-achievable by other conventional scarifiers.

With this in mind, reference is now made in detail to the description of the embodiments as illustrated in the drawings. While several embodiments are described in connection with these drawings, there is no intent to limit the disclosure to the embodiment or embodiments disclosed herein. On the contrary, the intent is to cover all alternatives, modifications, and equivalents.

FIG. 1 is a diagram showing an exploded view of one embodiment of a scarifier. As shown in FIG. 1, this particular embodiment is a walk-behind scarifier that comprises three distinct segments. The first segment is a proximal segment, the second segment is a middle segment, and the third segment is a distal segment.

The proximal segment is the portion of the walk-behind scarifier that the operator contacts when the scarifier is in use. Consequently, the proximal segment comprises a handlebar 25 that is mounted to a rear assembly weldment 3 by a handle mount 39. Those having skilled in the art will appreciate that these and other components, described below, are secured in their respective positions using various combinations of known hardware components, such as, for example, cap screws 53, 54, 61, machine screws 57, shoulder screws 59, flat washers 41, 55, 60, or other appropriate components. Thus, further discussion of screws 53, 54, 57, 59, 51, washers 41, 55, 60, and other minor components is omitted below.

In the embodiment of FIG. 1, the proximal segment further comprises an electrical enclosure that is formed using a top panel 31, a front panel 33, and a bottom panel 34 that are secured to the rear assembly weldment 3. The proximal segment, in this embodiment, also includes a battery tray 37 that secures a battery 30 in place using battery tie-down straps 72. Additionally, this embodiment of the proximal segment also comprises a fuel tank 29 and a hydraulic motor enclosure 4 that are both secured to the rear assembly weldment 3. Insofar as the hydraulic motor enclosure 4 is located on the proximal segment in this embodiment, the proximal segment also comprises hydraulic motor 38. A chain drive guard 71 is located above the hydraulic motor 38, and drive wheels 10 that are used for propelling the walk-behind scarifier are mounted on the proximal segment through a shaft bearing 24.

The middle segment, as shown in the embodiment of FIG. 1, comprises an engine mounting plate 74 that holds a scarifier engine (not shown in FIG. 1) atop the engine mounting plate 74. Also included in the middle segment is a throttle cable mount 8. Below the engine mounting plate 74 is a bearing housing 12 that couples to a drum assembly 11, which is covered by an access plate assembly 5 with a bearing cap 14. The drum assembly 11 is used to texturize surfaces or change the texture of various surfaces. This embodiment of the middle segment further comprises a pulley mount bracket 70, belt guard 27, and a tension pulley assembly 36, all of which are used with pulleys that form various portions of the driving and surfacing mechanisms for the walk-behind scarifier.

Of particular interest in the middle segment are skis 28 on both sides of the middle segment. The skis 28 are mechanically coupled to the middle segment using sleeve bearings 58, shoulder screws 58, and flat washers 59. This embodiment of the middle segment also comprises a ski adjustment shaft 69 that is mechanically coupled to the access plate assembly 5. As shown in the embodiment of FIG. 1, the ski 28 comprises an angle that permits the ski 28 to teeter on the surface at the location of the angle. Preferably, the angle of the ski 28 is located at approximately the same location where the drum assembly 11 contacts the ground. Consequently, this substantial co-location of the contact point of the drum assembly 11 and the angles on the skis 28 permits the drum assembly 11 to maintain better contact with the concrete. Thus, unlike conventional resurfacing machinery, when one of the drive wheels 10 of the inventive scarifier encounters a bump, rut, or other uneven surface, the skis 28 on the scarifier maintains the elevation of the drum assembly 11 with reference to the surface. As described in greater detail below, the middle segment is operatively coupled to the proximal segment to permit torsional movement of the middle segment with reference to the proximal segment.

Continuing with FIG. 1, this embodiment of the walk-behind scarifier also comprises a distal segment, which is the segment that is farthest from an operator when the walk-behind scarifier is in use. The distal segment comprises a front bumper weldment 6 that is capped with a finishing plug 75. Mechanically attached to the front bumper weldment 6 is a caster bracket weldment 1 to which front casters 9 are secured. A ride adjustment cylinder 16 is located at the distal segment, and a bumper cover panel 22 is secured to the front bumper weldment 6 using machine screws 57 or other securing hardware. In short, the distal segment forms a front bumper of the walk-behind scarifier.

Figure 2:
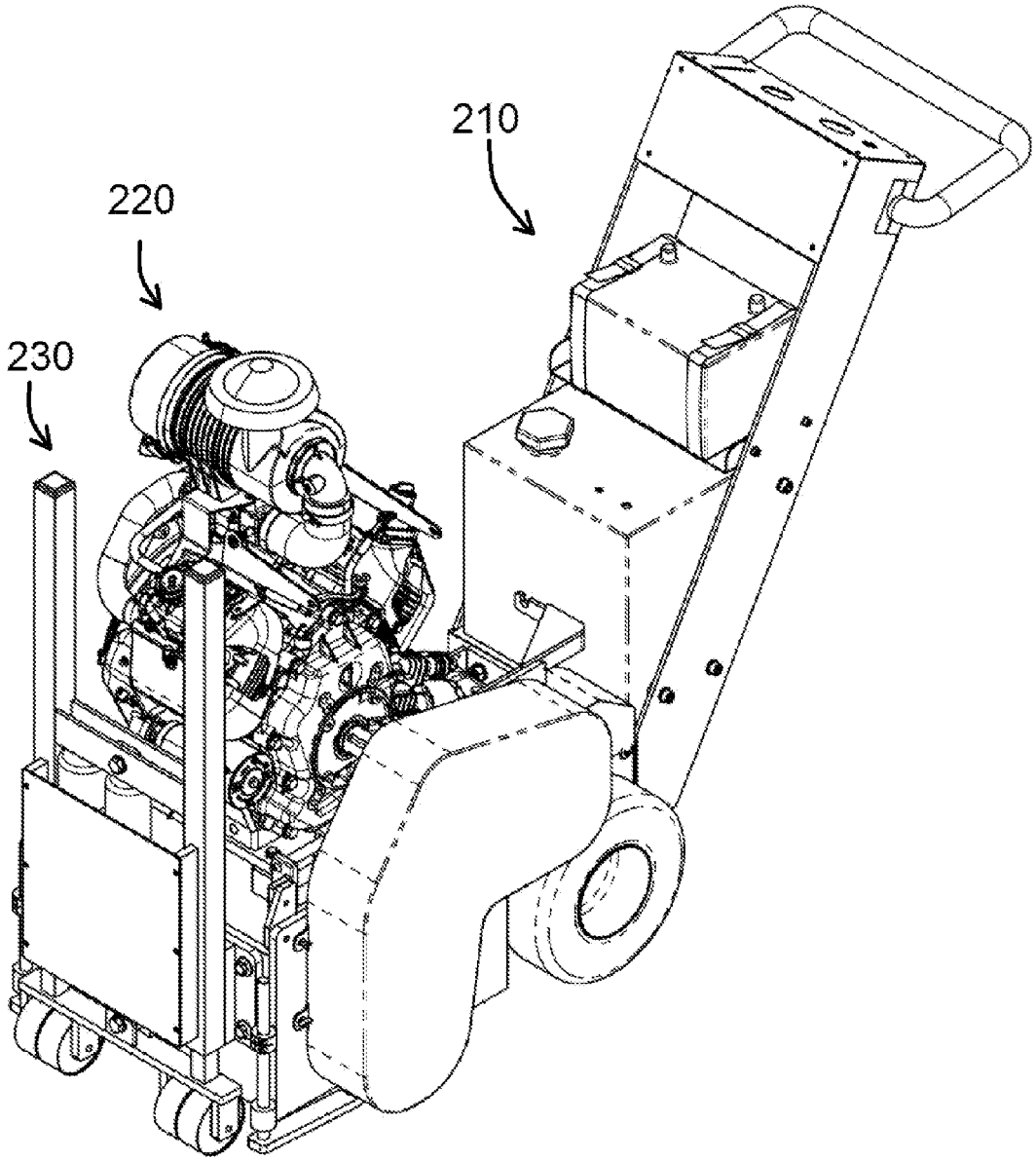
FIG. 2 is a diagram showing one embodiment of the scarifier of FIG. 1, as assembled.

FIG. 2 is a diagram showing one embodiment of the scarifier of FIG. 1, as assembled. As shown in the embodiment of FIG. 2, the scarifier comprises: (a) the proximal segment 210, where an operator holds the handlebar 26 to push the scarifier; (b) the middle segment 220, which comprises the drum assembly 11, the engine, and many of the other mechanical components of the scarifier; and (c) the distal segment 230, which includes a front bumper weldment 6.

Figure 3:
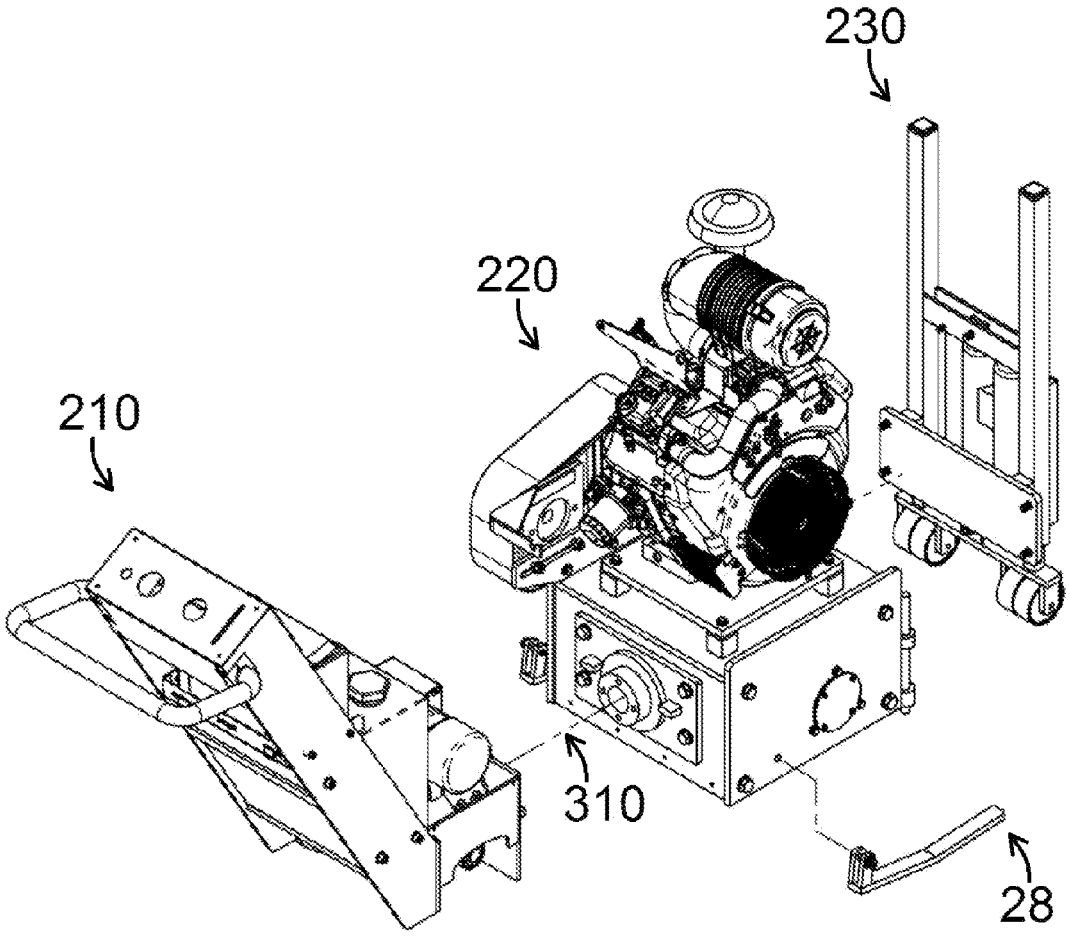
FIG. 3 is a diagram showing a rear-perspective, partially-disassembled view of the scarifier of FIG. 1.
Figure 4:
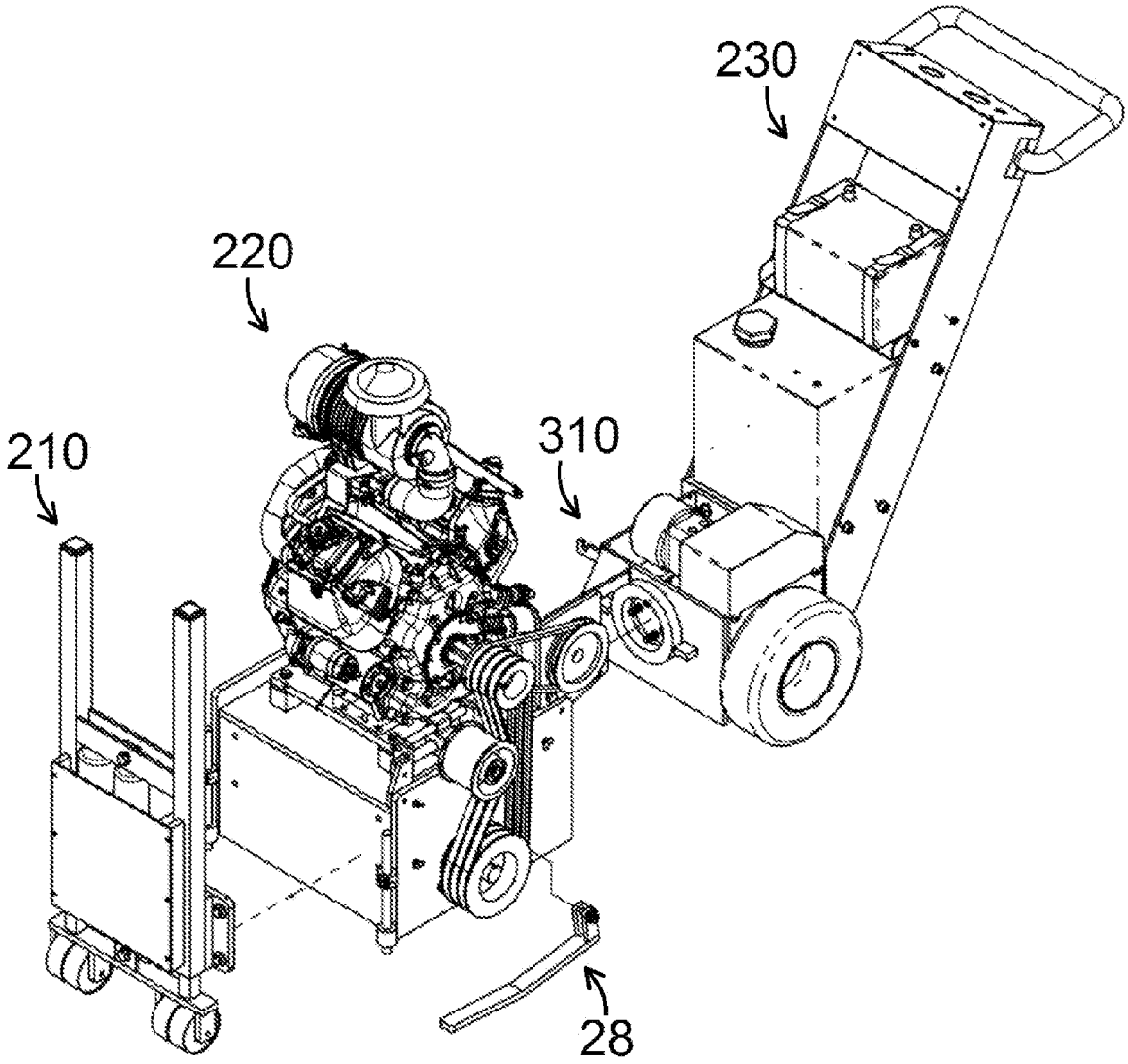
FIG. 4 is a diagram showing a front-perspective, partially-disassembled view of the scarifier of FIG. 1.

FIG. 3 shows a rear-perspective, partially-disassembled view of the scarifier of FIG. 1, while FIG. 4 shows a front-perspective, partially-disassembled view of the scarifier. Specifically, both FIG. 3 and FIG. 4 show the proximal segment 210, the middle segment 220, and the distal segment 230 separated from each other. FIGS. 3 and 4 also show a coupling interface 310 between the proximal segment 210 and the middle segment 220, which allows torsional movement of the proximal segment 210 with reference to the middle segment 230. In terms of roll, pitch, and yaw, the middle segment 220 is coupled 310 with the proximal segment 210 in such a way to allow the middle segment 220 to roll independently of the proximal segment 210. Stated differently, the flexible coupling 310 between the proximal segment 210 and the middle segment 220 provides an effect that is similar to a twist-beam suspension or a torsion-beam axle. This permits the drum assembly 11 to contour with the concrete, somewhat independently of the vertical movement of the drive wheels 10. Thus, even if one of the drive wheels 10 encounters a rut, bump, or other surface defect that causes the drive wheel 10 to move up or down, the drum assembly 11 (which is in the middle segment 220) remains relatively even with the ground. Preferably, the torsional movement is restricted to a finite range of angles, thereby also providing some degree of rigidity and stability to the scarifier as a whole. Since different applications and surfaces may require different degrees of flexibility, those having skill in the art will appreciate that the finite range of angles can vary as applicable, and will also know how to determine those ranges for those varying applications.

Furthermore, installing skis 28 on the scarifier (as shown in FIGS. 3 and 4) permits the scarifier to maintain better contact with the concrete or other surface for which the texture is being altered. Specifically, the skis 28 in this embodiment have an angle that is located at approximately the location where the drum assembly 11 contacts the ground. Consequently, this co-location of the contact point of the drum assembly 11 and the angles on the skis 28 permits the drum assembly 11 to maintain better contact with the concrete. Thus, unlike machinery from other companies, when one of the drive wheels 10 of the inventive scarifier encounters a bump, rut, or other uneven surface, the skis 28 on the scarifier maintains the elevation of the drum assembly 11 with reference to the surface of the concrete (or other surface for which the texture is being altered).

Figure 5:
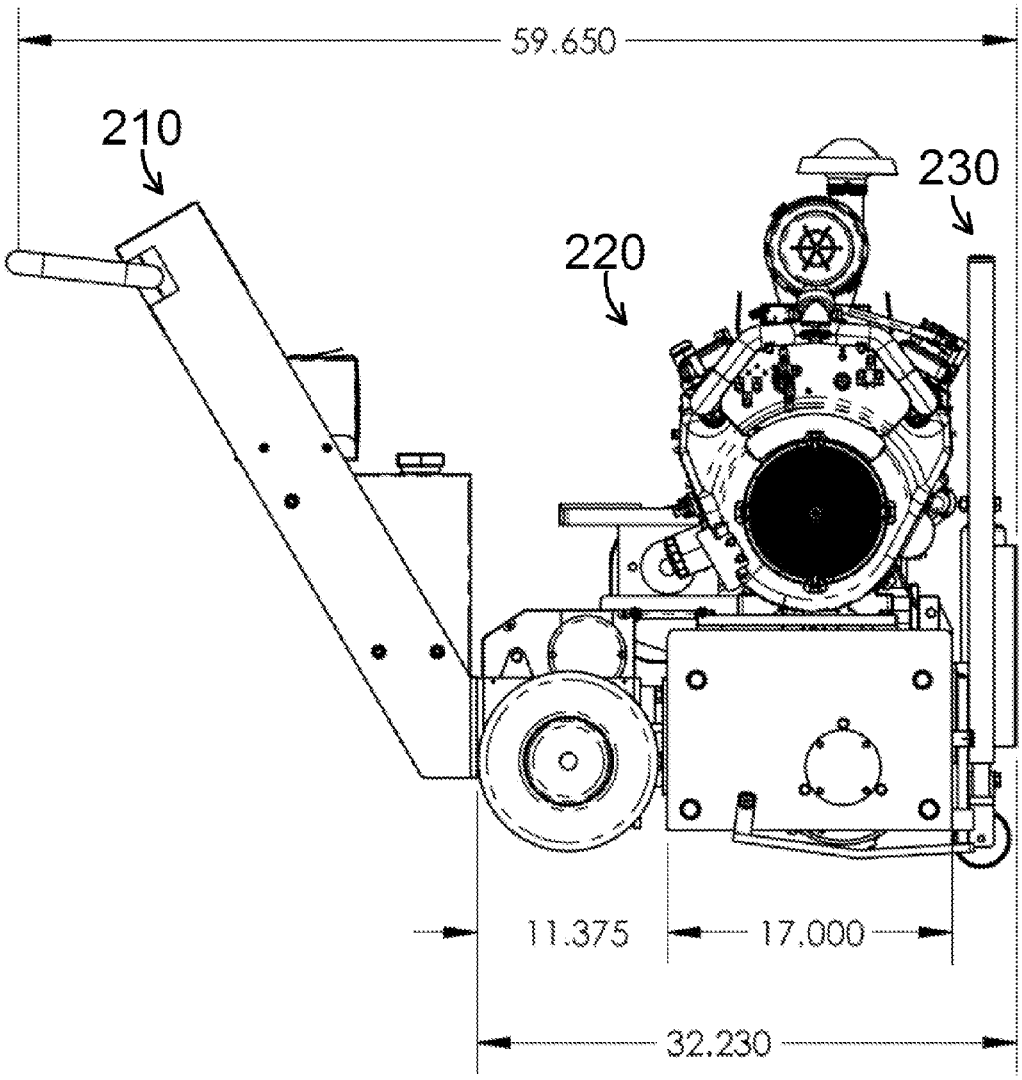
FIG. 5 is a diagram showing a side view of the assembled scarifier of FIG. 2.
Figure 6:
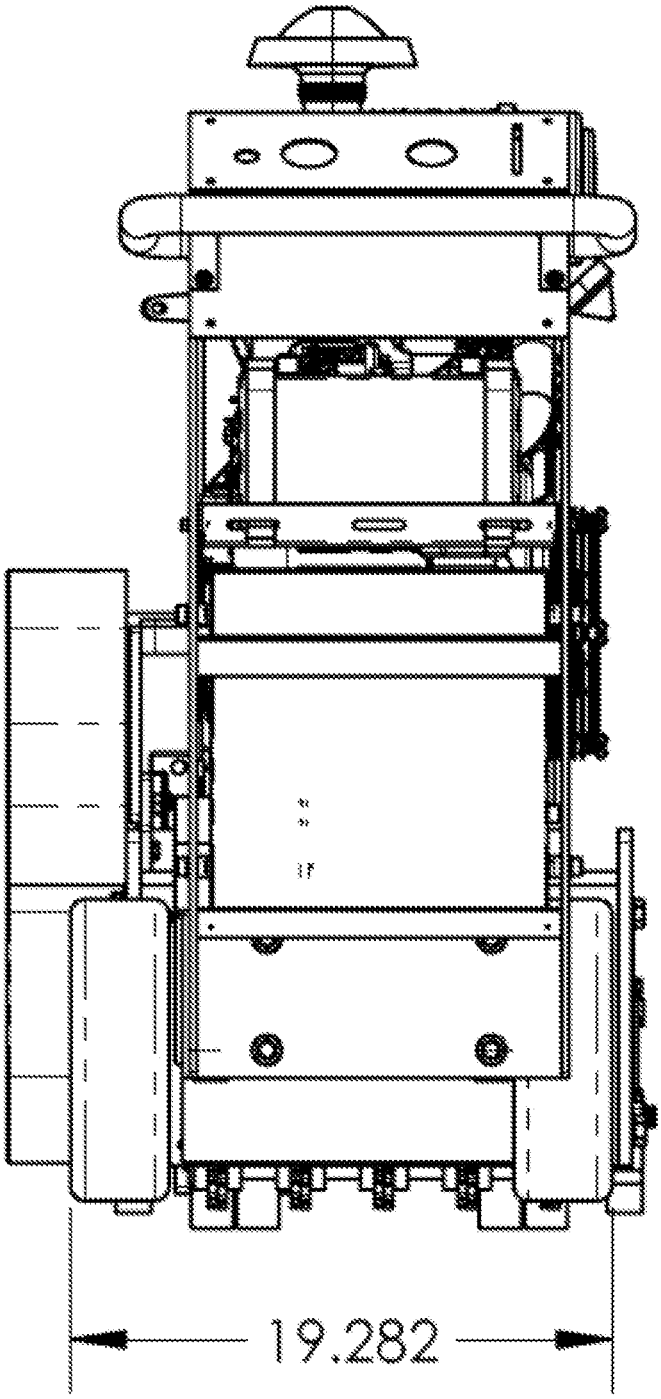
FIG. 6 is a diagram showing a rear view of the assembled scarifier of FIG. 2.
Figure 7:
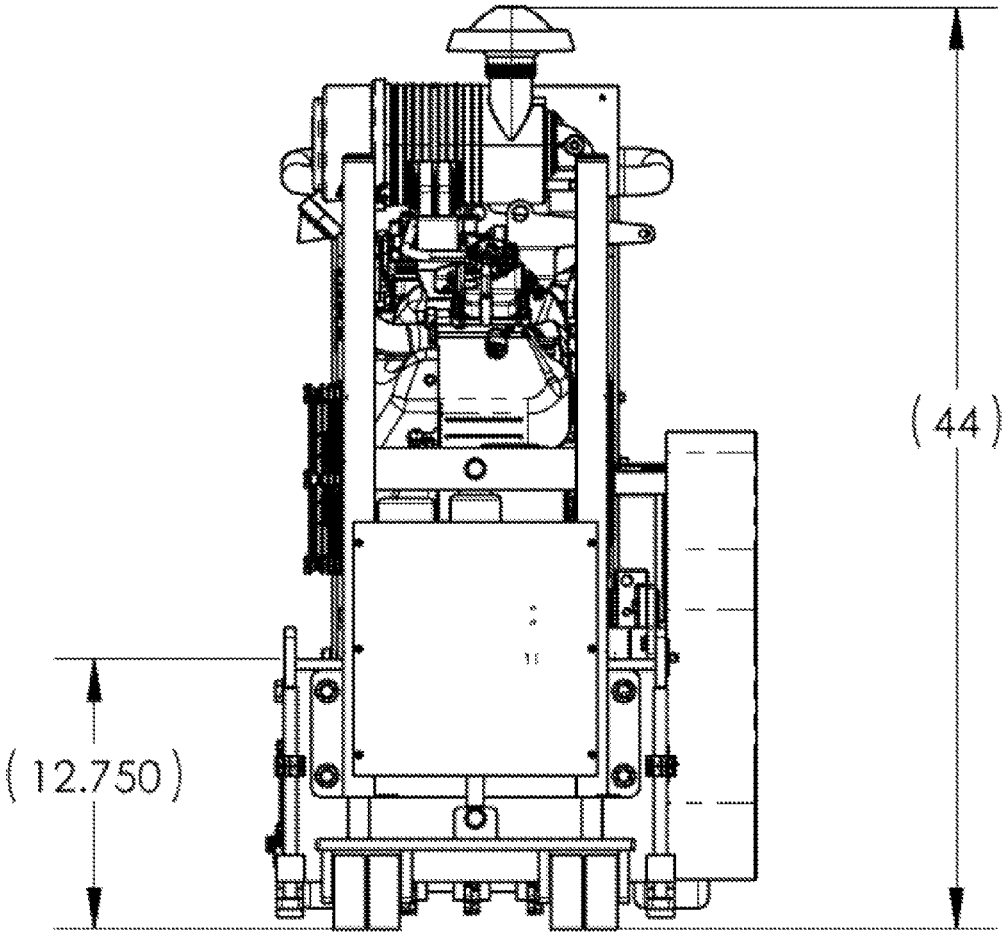
FIG. 7 is a diagram showing a front view of the assembled scarifier of FIG. 2.
Figure 8:
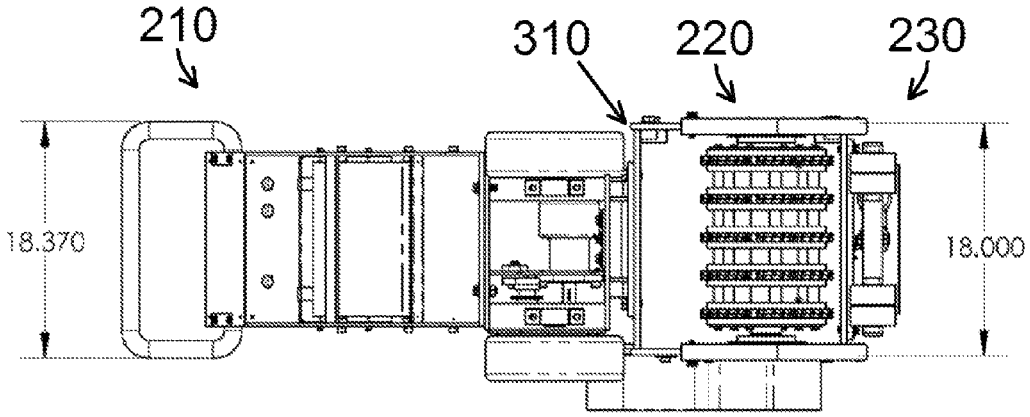
FIG. 8 is a diagram showing a bottom view of the assembled scarifier of FIG. 2.
Figure 9:
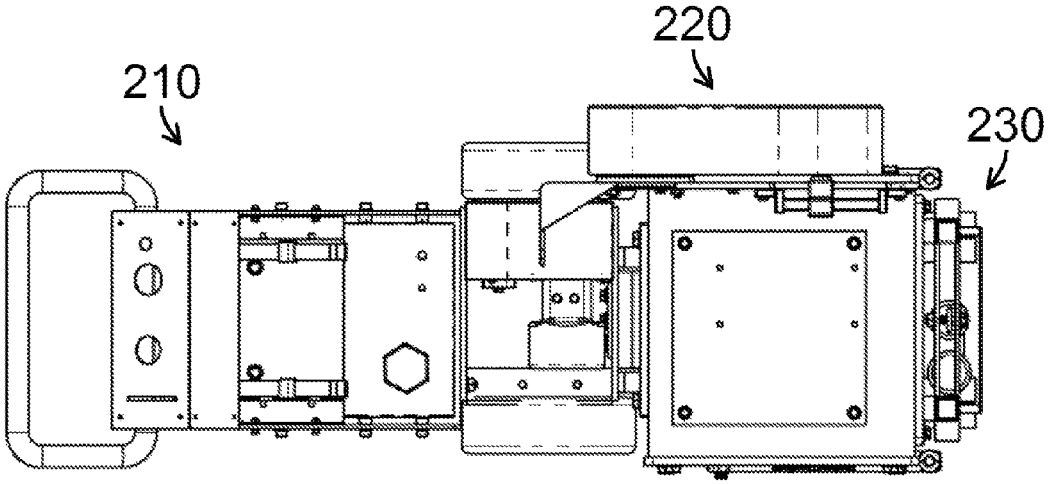
FIG. 9 is a diagram showing a top view of the assembled scarifier of FIG. 2.

FIG. 5 shows a side view, while FIG. 6 shows a rear view, FIG. 7 shows a front view, FIG. 8 shows a bottom view, and FIG. 9 shows a top view of the assembled scarifier. For one preferred embodiment, the scarifier is dimensioned in such a way that it permits a user to walk behind the scarifier and physically push the scarifier without using additional driving equipment to propel forward the scarifier.

By way of example, as shown in the embodiment of FIG. 5, these dimensions include an end-to-end length (from one end at the proximal segment to an opposing end at the distal segment) that is approximately sixty (60) inches with the length of the middle segment being approximately seventeen (17) inches and the segment with the drive wheel 10 being approximately eleven (11) inches. For some embodiments, the distance from the drive wheel 10 to the bumper cover panel 22 is approximately thirty-two (32) inches.

As shown in the embodiment of FIGS. 6, 7 and 8, a wheel-to-wheel width (measured from a left drive wheel to a right drive wheel) is approximately nineteen (19) inches, while the drum assembly 11 is approximately eighteen (18) inches wide. For some embodiments, the scarifier has a total height of approximately forty-four (44) inches, with the engine mounting plate 74 being approximately thirteen (13) inches above the ground. Although specific dimensions have been provided to show a preferred embodiment, it should be appreciated that these dimensions may be altered to accommodate different scarifiers and various resurfacing equipment, depending on the application.

Although exemplary embodiments have been shown and described, it will be clear to those of ordinary skill in the art that a number of changes, modifications, or alterations to the disclosure as described may be made. All such changes, modifications, and alterations should therefore be seen as within the scope of the disclosure.

What is claimed is:

1. A walk-behind scarifier, comprising:

(a) a proximal segment, comprising:

(a1) a rear assembly weldment;

(a2) a handlebar mechanically coupled to the rear assembly weldment;

(a3) an electrical enclosure secured to the rear assembly weldment;

(a4) a battery tray mechanically coupled to the rear assembly weldment; and (a5) drive wheels for propelling the walk-behind scarifer;

(b) a middle segment torsionally coupled to the proximal segment, the middle segment comprising:

(b1) an engine;

(b2) an engine mounting plate to hold the engine; and (b3) a drum assembly driven by the engine, the drum assembly to texturize a surface when the drum assembly contacts the surface; and (b4) a ski mechanically secured to the middle segment, the ski having an angle, the angle providing a contact point between the ski and the surface, the ski for to maintain a controlled elevation of the drum assembly with reference to the surface; and (c) a distal segment mechanically coupled to the middle segment, the distal segment comprising:

(c1) a front bumper weldment; and (c2) casters on the front bumper weldment.

2. A scarifier, comprising:

a first segment comprising drive wheels for propelling the scarifier, the first segment further comprising a fuel tank; and a second segment torsionally coupled to the first segment, the second segment comprising a drum assembly for texturizing a surface, the second segment further comprising an engine.

3. The scarifier of claim 2, the first segment further comprising a handle.

4. The scarifier of claim 2, the first segment further comprising a battery tray.

5. The scarifier of claim 2, the first segment further comprising an electrical enclosure.

6. The scarifier of claim 2, the second segment further comprising a ski that maintains the drum assembly at a controlled elevation above the surface.

7. The scarifier of claim 6, the ski comprising an angle, the angle providing a contact point between the ski and the surface.

8. The scarifier of claim 2, further comprising a third segment mechanically coupled to the second segment.

9. The scarifier of claim 8, the third segment comprising a front bumper weldment.

10. A scarifier, comprising:

a drum assembly for texturizing a surface;

a first ski located on a left side of the drum assembly;

a second ski located on a right side of the drum assembly, the second ski and the first ski to maintain a controlled elevation of the drum assembly with reference to the surface.

11. The scarifier of claim 10, the first ski comprising a first angle, the first angle for contacting the surface.

12. The scarifier of claim 10, the second ski comprising a second angle, the second angle for contacting the surface.

13. The scarifier of claim 10, comprising a middle segment comprising the drum assembly.

14. The scarifier of claim 13, the middle segment further comprising the first ski, the middle segment further comprising the second ski.

15. The scarifier of claim 10, comprising a proximal segment torsionally coupled to the middle segment.

16. The scarifier of claim 15, the proximal segment comprising drive wheels.

17. The scarifier of claim 16, the proximal segment comprising a handle.

18. The scarifier of claim 10, comprising a distal segment mechanically coupled to the middle segment, the distal segment comprising a front bumper weldment.

* * * * *